US011560534B2

(12) United States Patent
Piorkowski

(10) Patent No.: US 11,560,534 B2
(45) Date of Patent: Jan. 24, 2023

(54) SURFACTANT COMPOSITIONS FOR IMPROVED TRANSPARENCY OF DADMAC-ACRYLAMIDE CO-POLYMERS

(71) Applicant: Henkel AG & Co. KGaA, Duesseldorf (DE)

(72) Inventor: Daniel Thomas Piorkowski, Trumbull, CT (US)

(73) Assignee: Henkel AG & Co. KGaA

( * ) Notice: Subject to any disclaimer, the term of this patent is extended or adjusted under 35 U.S.C. 154(b) by 115 days.

(21) Appl. No.: 17/122,715

(22) Filed: Dec. 15, 2020

(65) Prior Publication Data

US 2022/0186145 A1 Jun. 16, 2022

(51) Int. Cl.

| | |
|---|---|
| ***C11D 3/37*** | (2006.01) |
| ***C11D 1/29*** | (2006.01) |
| ***C11D 1/22*** | (2006.01) |
| ***C11D 17/08*** | (2006.01) |

(52) U.S. Cl.
CPC ..... *C11D 3/3719* (2013.01); *C11D 1/22* (2013.01); *C11D 1/29* (2013.01); *C11D 17/08* (2013.01)

(58) Field of Classification Search
CPC ..... C11D 3/3719; C11D 17/0013
See application file for complete search history.

(56) References Cited

U.S. PATENT DOCUMENTS 4,077,930 A * 3/1978 Lim ..... D21H 17/455 524/808
4,715,962 A * 12/1987 Bhattacharyya ..... B01D 17/047 210/708
4,844,821 A 7/1989 Mermelstein et al.
4,913,828 A 4/1990 Caswell et al.
5,073,274 A 12/1991 Caswell
5,723,426 A 3/1998 Zhen et al.
6,369,018 B1 4/2002 Hsu et al.
6,616,705 B2 9/2003 Kischkel et al.
6,620,209 B2 9/2003 Kischkel et al.
6,949,498 B2 9/2005 Murphy et al.
(Continued)

FOREIGN PATENT DOCUMENTS

DE 102017209211 A1 12/2018
EP 1163320 A1 12/2001
(Continued)

OTHER PUBLICATIONS

European Search Report for Application No. EP 21210935 dated Apr. 12, 2022.

(Continued)

*Primary Examiner* — Liam J Heincer
*Assistant Examiner* — M. Reza Asdjodi
(74) *Attorney, Agent, or Firm* — St. Onge Steward Johnston & Reens LLC

(57) ABSTRACT

Liquid laundry detergent compositions including a Diallyldialkylammonium Chloride (DADMAC) Acrylamide copolymer, and a surfactant system comprising at least one non-ionic surfactant (NI) and at least one linear alkylbenzene sulfonate anionic surfactant (LAS) where the composition has a turbidity of about 50 NTUs or less. The NI is at least about 30 percent by weight of the surfactant system and the LAS is less than about 40 percent by weight of the surfactant system. The surfactant system can also include alcohol ethoxysulfate (AES).

18 Claims, 1 Drawing Sheet

(56) References Cited

U.S. PATENT DOCUMENTS

| | | | | |
|---|---|---|---|---|
| 7,056,879 | B2 | 6/2006 | Wang et al. | |
| 7,772,175 | B2 | 8/2010 | Panandiker et al. | |
| 8,263,544 | B2 | 9/2012 | Panandiker et al. | |
| 2002/0055451 | A1 | 5/2002 | Kischkel et al. | |
| 2003/0083223 | A1 | 5/2003 | Aubay et al. | |
| 2004/0039101 | A1 | 2/2004 | Dubief et al. | |
| 2004/0121930 | A1 | 6/2004 | Wang et al. | |
| 2007/0274942 | A1 | 11/2007 | Morvan et al. | |
| 2013/0118531 | A1 | 5/2013 | Dobrawa et al. | |
| 2013/0123372 | A1 | 5/2013 | Dobrawa et al. | |
| 2015/0376552 | A1 | 12/2015 | Si et al. | |
| 2017/0335237 | A1 | 11/2017 | Fossum et al. | |
| 2017/0369818 | A1* | 12/2017 | Park | C11D 1/29 |
| 2018/0216034 | A1 | 8/2018 | Camire et al. | |
| 2018/0265825 | A1* | 9/2018 | Park | C11D 1/94 |
| 2019/0352580 | A1* | 11/2019 | Piorkowski | G01B 11/303 |
| 2022/0135912 | A1* | 5/2022 | Piorkowski | C11D 1/831 510/416 |

FOREIGN PATENT DOCUMENTS

| | | | |
|---|---|---|---|
| EP | 1698688 | A1 | 9/2006 |
| WO | 9731998 | A1 | 9/1997 |
| WO | 0056849 | A1 | 3/2000 |
| WO | 0070005 | A1 | 11/2000 |
| WO | 2006012984 | A1 | 2/2006 |
| WO | 2013070559 | A1 | 5/2013 |
| WO | 2013071036 | A1 | 5/2013 |
| WO | 2016049458 | A1 | 3/2016 |
| WO | 2019014086 | A1 | 1/2019 |
| WO | 2019084375 | A1 | 5/2019 |
| WO | 2019117902 | A1 | 6/2019 |

OTHER PUBLICATIONS

European Search Report for Application No. EP 21210937 dated Apr. 12, 2022.

* cited by examiner

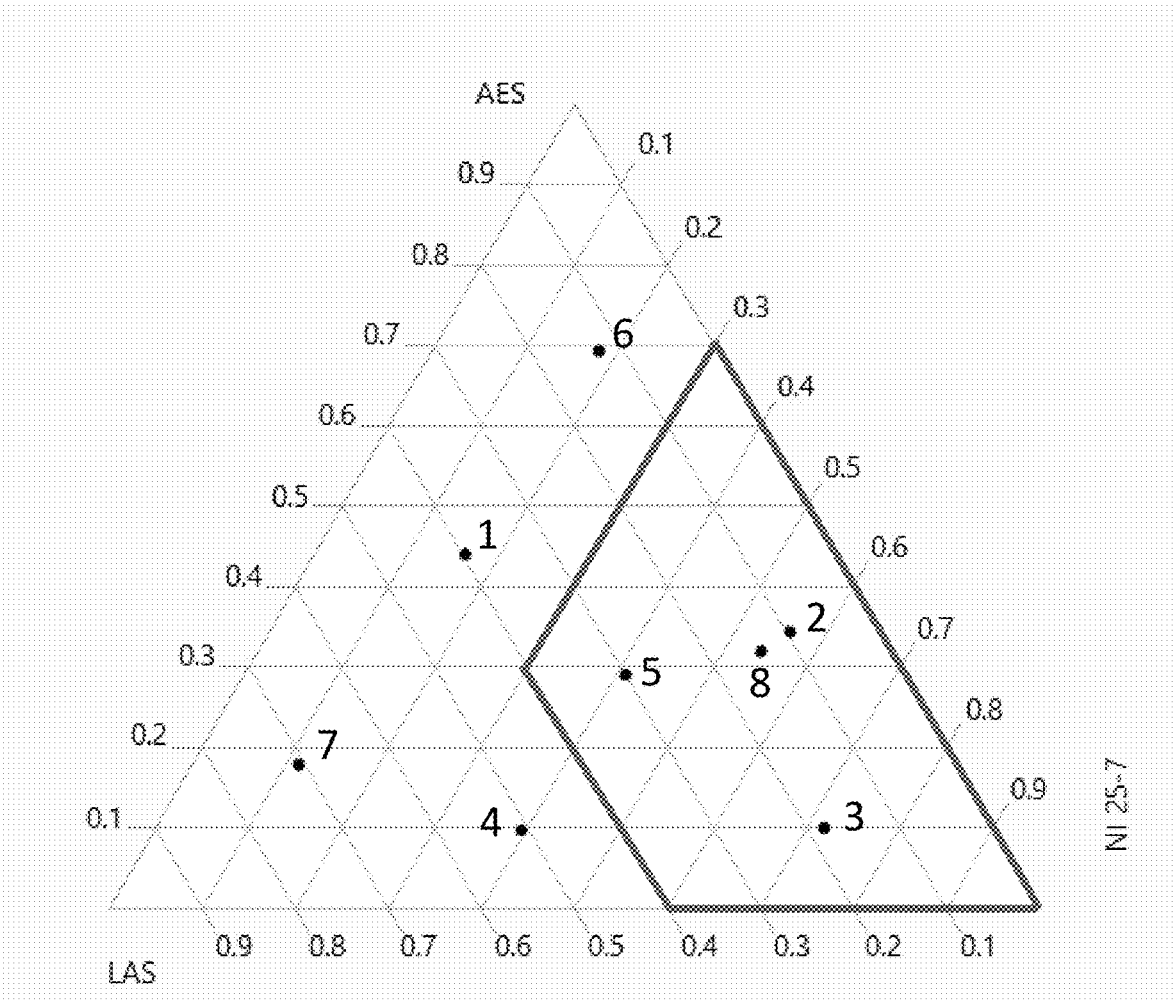
AES
LAS
NI 25-7
0.1
0.2
0.3
0.4
0.5
0.6
0.7
0.8
0.9
1
2
3
4
5
6
7
8

SURFACTANT COMPOSITIONS FOR IMPROVED TRANSPARENCY OF DADMAC-ACRYLAMIDE CO-POLYMERS

FIELD OF THE INVENTION

The invention relates to liquid detergent compositions containing Diallyldialkylammonium Chloride (DADMAC) Acrylamide co-polymers and anionic surfactants, which are stable and remain clear.

BACKGROUND OF THE INVENTION

Many consumers have adopted the use of fabric softeners as part of their laundry procedure. Fabric softeners can provide superior garment appearance; excellent tactile characteristics, such as fabric feel and softness; fabric softness; reduction, removal or prevention of creases or wrinkles in garments; ease of ironing; garment shape retention and/or shape recovery; and fabric elasticity.

Typical softeners are often cationically charged polymers which do not interact well with common detergent compositions comprising anionic surfactants. Nevertheless, various "2-in-1 detergent compositions" that provide both cleaning and fabric softening benefits have been introduced to the market with varying success. Some of the known 2-in-1 detergent products have a cloudy appearance apparently caused by insoluble light-scattering materials. In some products, the cloudiness is so pronounced that the product has a light transmittance of less than 50%.

Commonly used surfactants include mixtures of non-ionic alcohol ethoxylates and anionic surfactants selected from linear alkyl benzene sulfonic acids, neutralized fatty acids, secondary alkane sulfonates, and alcohol ethoxy sulfates. Many commercially popular detergents contain a cocktail of these surfactants to achieve cleaning results.

Diallyldialkylammonium Chloride (DADMAC) polymers are utilized in many commercial fabric softener products. DADMAC polymers present similar formulation challenges as other cationic polymers.

U.S. Pat. No. 8,263,544 reports that when DADMAC polymers are incorporated in liquid laundry detergent, they produce two-phased opaque products. The patent suggests that a stable detergent composition having softener can be made where the detergent comprises (a) from about 0.01% to about 10% by weight of the composition of a benefit agent, wherein said benefit agent is a perfume microencapsulate; (b) from about 0.0001% to about 10% by weight of the composition of a non-polysaccharide based deposition polymer, the deposition polymer comprising one or more cationic monomeric units and one or more non-ionic monomeric units; (c) from about 1 to about 25% by weight of the composition of a detersive surfactant; (d) from about 0.0001 to about 20% by weight of the composition of a laundry adjunct; and (e) a cellulase enzyme; and (f) the balance a carrier comprising water. However, many consumers desire "free and clear" laundry products that do not contain perfumes and other adjuncts that can irritate sensitive skin.

U.S. Pat. No. 6,949,498 discloses laundry compositions containing mixtures of one or more anionic surfactants and one or more cationic polymers that deliver an unexpectedly high level of conditioning to fabrics and which are substantially transparent for aesthetic reasons. Preferably, the compositions yield softening parameters of greater than 40, with Polymer JR 30M being the exemplified cationic softening agent. The preferred ratio of cationic polymertotal surfactant is less than about 1:4, whereas the preferred ratio of cationic polymer:anionic surfactant will be less than about 1:5, and the preferred ratio of cationic polymer:non-ionic surfactant will be less than about 1:5.

The inventor has found that when DADMAC Acrylamide co-polymer was added to existing commercially transparent and perfume free detergent formulations containing a mixture of non-ionic and anionic surfactant, the detergent compositions became cloudy, indicating instability, especially when the detergent compositions contained greater than about 16% water. It is possible that the cloudiness is a consequence of turbidity associated with the precipitation of anion-cation complexes arising from the interaction of the cationic polymer with anionic surfactants. The cloudiness associated with such precipitation is undesirable as a consumer may be misled by the cloudiness as to the quality of the product. For example, a consumer may consider a product which turns cloudy during the course of usage to be of poor quality. A consumer may even conclude that the product has gone bad and may dispose of still-usable product.

There remains a need for laundry detergent compositions having fabric softening effects, which are transparent and free of perfumes. In particular, there remains a need for laundry detergent compositions which are stable and provide superior cleaning and fabric care benefits. Moreover, it is desirable that such laundry detergent compositions have greater than about 20% water. There is particularly a desire for a detergent comprising DADMAC Acrylamide Copolymer, where the composition is stable and has a clear appearance.

SUMMARY OF THE INVENTION

The foregoing objectives are achieved by provision of liquid laundry detergent compositions comprising a Diallyldialkylammonium Chloride (DADMAC) Acrylamide copolymer; a surfactant system comprising at least one non-ionic surfactant (NI) and at least one linear alkylbenzene sulfonate anionic surfactant (LAS), the NI being at least about 30 percent by weight of the surfactant system, the LAS being less than about 40 percent by weight of the surfactant system; and an aqueous carrier, wherein the composition has a turbidity of about 50 NTUs or less, preferably about 45 NTUs or less, more preferably about 40 NTUs or less, most preferably less than 10 NTUs.

In certain embodiments, the surfactant system further comprises an alcohol ethoxysulfate anionic surfactant (AES), the amount of AES being less than about 60 percent by weight of the surfactant system.

In some embodiments, the surfactant system consists essentially of NI, LAS and AES. In certain embodiments, the surfactant systems consists of NI, LAS and AES.

In some embodiments, the surfactant system consists essentially of NI and LAS. In certain embodiments, the surfactant system consists of NI and LAS.

Advantageously, the compositions remain stable without inclusion of a perfume. Thus, in preferred embodiments, the liquid laundry detergent compositions do not include a perfume.

In certain preferred embodiments, the NI is an alcohol ethoxylate (AE).

In some embodiments the surfactant system consists essentially of an AES, a LAS, and an NI. In certain embodiments, the surfactant system consists of an AES, a LAS, and an NI. In certain of those embodiments, the ratio of LAS:NI is about 1:1.5 to about 1:6 and/or the ratio of LAS:AES is about 1:1 to about 1:4.

In some embodiments, the ratio of LAS:AES:NI is about 1:3.4:5.6. In other embodiments, the ratio of LAS:AES:NI is about 1.0:0.5:3.6. In yet other embodiments, the ratio of LAS:AES:NI is about 1:1:1.5. In some other embodiments, the ratio of LAS:AES:NI is about 1:2:3.6.

In preferred embodiments, the NI is about 35 to about 80 weight percent based on weight of the surfactant system. Most preferably, the NI is about 40 to about 75 weight percent based on weight of the surfactant system.

In certain embodiments, the LAS is about 0 to about 40 weight percent based on weight of the surfactant system. In some of those embodiments the LAS is about 0 to about 30 percent. In other embodiments, the LAS is about 10 to about 30 weight percent based on weight of the surfactant system. In some of those embodiments, the LAS is about 20 to about 30, or about 20 to about 35, or about 35 to about 40 weight percent based on weight of the surfactant system. In certain preferred embodiments, the LAS is about 20 weight percent to about 30 weight percent based on weight of the surfactant system.

In some embodiments, the AES is about 0 to about 55 weight percent based on weight of the surfactant system. In some of those embodiments, the AES is about 20 to about 55, or about 30 to about 55, or about 10 to about 50, or about 10 to about 25, or about 10 to about 30, or about 30 to about 50 weight percent based on weight of the surfactant system.

In some embodiments, the DADMAC Acrylamide co-polymer comprises less than 1 weight percent based on total weight of the detergent composition. In certain embodiments, the DADMAC Acrylamide co-polymer comprises less than 0.5 weight percent based on total weight of the detergent composition. In some embodiments, the DADMAC Acrylamide co-polymer comprises about 0.35 to about 0.40 weight percent based on total weight of the detergent composition In certain embodiments, water comprises greater than about 20 weight percent based on the total weight of the detergent composition. In preferred embodiments, water comprises about 30 to about 80 weight percent based on total weight of the detergent composition. In some of those embodiments, water comprises about 40 to about 75 weight percent based on total weight of the detergent composition.

In some embodiments, total active surfactant present in the detergent composition is about 8 to about 35 weight percent based on total weight of the detergent composition. In some of those embodiments, total active surfactant comprises about 10 percent to about 35 weight percent based on total weight of the detergent composition. In some of those embodiments, the total active surfactant present comprises about 10 percent to about 28 weight percent based on total weight of the detergent composition. In certain advantageous embodiments, the total active surfactant comprises about 12 to about 13 weight percent based on the total weight of the detergent composition.

In some embodiments, total active surfactant comprises an NI. In other embodiments, the total active surfactant comprises an NI and a LAS. In certain other embodiments, the total active surfactant comprises an NI, a LAS and an AES.

In certain preferred embodiments, the total active surfactant consists essentially of the NI/LAS/AES surfactant system. In other preferred embodiments, the total active surfactant consists of the NI/LAS/AES surfactant system, such that the weight percent of total active surfactant is the same as the weight percent of the NI/LAS/AES surfactant system.

In some embodiments, the active surfactant further incudes a fatty acid. In some of those embodiments, the fatty acid is coco fatty acid.

In some preferred compositions, the surfactant system comprises 30 to 100 weight percent NI, 0 to 40 weight percent LAS and 0 to 70 weight percent AES. In some of those embodiments, the surfactant system comprises 35 to 80 weight percent NI and 0 to 40 weight percent LAS, the weight percents being based on total weight of the surfactant system. In some of those embodiments, the AES is about 0 to 55, more preferably 10 to about 50 weight percent.

In some embodiments, the surfactant system comprises system comprises 40 to 75 weight percent of a non-ionic surfactant (NI), 0 to 30 weight percent of a linear alkyl benzene sulfonic acid (LAS), and 10 to 50 weight percent of an alcohol ethoxysulfate (AES). In some of those embodiments, the NI is about 40-75 weight percent, the LAS is about 0-30 weight percent, and the AES is about 10-35 weight percent.

In certain embodiments, the liquid laundry detergent composition further comprises an adjunct ingredient selected from enzyme, bleach, bleach activator, enzyme stabilizing system, redeposition polymers, or combinations thereof. In some of those embodiments, the adjunct ingredient is an enzyme.

In certain preferred embodiments, the liquid laundry detergent composition comprises a Diallyldialkylammonium Chloride (DADMAC) Acrylamide co-polymer; water present in an amount greater than 20 weight percent based on total weight of the detergent composition; and total active surfactant present in an amount of about 8 to about 35 weight percent based on total weight of the detergent composition, the total active surfactant comprising non-ionic surfactant (NI) and linear alkylbenzene sulfonate anionic surfactant (LAS), the amount of NI being at least about 30 weight percent based on weight of the total active surfactant, and the amount of (LAS) being less than 40 weight percent based on weight of the total active surfactant. The detergent composition has a turbidity less than 50 NTUs, preferably less than 45, more preferably less than 40 NTUs, most preferably less than 10 NTUs.

In certain of those embodiments, the surfactant system further comprises an alcohol ethoxysulfate (AES).

BRIEF DESCRIPTION OF THE DRAWINGS

The FIGURE is a ternary plot showing the ratio of alcohol ethoxysulfate (AES), linear alkyl benzene sulfonic acid (LAS), and non-ionic surfactant (NI) in the compositions of Example 1.

DETAILED DESCRIPTION OF THE INVENTION

The following detailed description is merely exemplary in nature and is not intended to limit the laundry detergent compositions or the methods for producing or using the same. Furthermore, there is no intention to be bound by any theory presented in the preceding background or the following detailed description.

Provided herein are liquid detergent compositions that include a DADMAC Acrylamide co-polymer and which are stable and clear. More particularly, the liquid detergent compositions include a DADMAC Acrylamide co-polymer, a surfactant system comprising non-ionic surfactant (NI) and linear alkylbenzene sulfonate anionic surfactant (LAS), the NI being at least about 30 percent by weight of the surfactant system, the LAS being less than about 40 percent by weight of the surfactant system; and an aqueous carrier. The compositions are clear and stable.

Preferably, these compositions include one or more cleaning enhancers, such as optical brighteners, enzymes or redeposition polymers and do not contain any perfumes.

In addition, these compositions should contain less than about 10% phosphate, in order to minimize their environmental impact.

"Liquid" or "liquid composition", as referred to herein, is any composition that has a viscosity. More particularly, for purposes herein, liquids are compositions that flow under influence of a force such as gravity, agitation, etc. It is to be appreciated that the liquid compositions may contain particulate components therein provided that the composition retains a viscosity and the presence of a separate particulate phase does not change the character of the composition from being a liquid.

The term "laundry composition" or "detergent composition" as used herein, refers to a composition that provides cleaning as well as fabric care benefits. The term encompasses compositions for handwash, machine wash and other purposes such as soaking and/or pretreatment of stained fabrics.

Except in the operating and comparative examples, or where otherwise explicitly indicated, all numbers in this description indicating amounts or ratios of material or conditions of reaction, physical properties of materials and/or use are to be understood as modified by the word "about".

The term "about" as used in connection with a numerical value throughout the specification and the claims denotes an interval of accuracy, familiar and acceptable to a person skilled in the art. In general, such interval of accuracy is .+−0.10%. Thus, "about ten" means 9 to 11. All numbers in this description indicating amounts, ratios of materials, physical properties of materials, and/or use are to be understood as modified by the word "about," except as otherwise explicitly indicated.

As used herein, the term "comprising" means including, made up of, composed, characterized by or having.

As used herein, a formula shall be considered physically "stable" when after 1 week at 21 degrees Celsius it exhibits no signs of phase separation.

As used herein, "clear" means having turbidity of about 50 NTUs or less. Clear compositions are substantially free of precipitation.

Turbidity, as used herein, is defined as the cloudiness or haziness of a solution caused by finely suspended particles. Turbidity is measured using nephelometric turbidity units (NTU). As used herein, low turbidity suspensions are those generally having a low solids concentration (on a weight basis), i.e., a solids weight percent of 0.1 or less. This typically corresponds with an approximate turbidity of 50 NTU's or less, but may vary due to the nature of the solids or dissolved colored matter. High solids suspensions include those systems containing in excess of 0.1 weight percent suspended solids, which generally corresponds to a turbidity of greater than 50 NTU's.

Substantially free of precipitation means that insoluble and substantially insoluble matter will be limited to less than about 10% of the composition, more preferable to about 5% or less.

Laundry Detergent Composition

The detergent compositions of the present invention are typically in the liquid form, preferably using water as an aqueous carrier. Encapsulated and/or unitized dose compositions are included, as are compositions which comprise two or more separate but combinedly dispensable portions. The detergent composition of the present invention comprises a DADMAC Acrylamide Copolymer, non-ionic surfactant, and, typically, LAS anionic surfactant, and AES anionic surfactant, and other laundry adjuncts, preferably in a carrier comprising water. The detergent composition of the present invention has a viscosity from about 1 to about 2000 centipoise (1-2000 mPa*s), or from about 200 to about 800 centipoises (200-800 mPa*s). The viscosity can be determined using a Brookfield viscometer, No. 2 spindle, at 60 RPM's, measured at 25° C.

The balance of the detergent compositions of the present invention comprises a carrier, which typically comprises water, and optionally organic solvents. In some embodiments, water is from about 85 to about 100 wt % of the carrier.

The amount of water is typically greater than 20 wt % of the detergent composition. Preferably, the amount of water is about 30 to about 80 wt % based on total weight of the detergent composition. Most preferably, water comprises about 40 to about 75 wt % based on total weight of the detergent composition.

The detergent compositions of the present invention may comprise effective amounts of laundry adjuncts, such as enzyme, bleach, bleach activator, enzyme stabilizing system, or combinations thereof. Unless specified hereinbelow, an "effective amount" of a particular laundry adjunct is preferably from about 0.0001%, more preferably from about 0.01%, even more preferably from about 1% to about 25%, more preferably to about 20%, even more preferably to about 15%, still even more preferably to about 10%, most preferably to about 5% by weight of the composition.

It is to be appreciated that additional components may be included in the liquid detergent composition in accordance with the present disclosure and as addressed below. However, the DADMAC Acrylamide Co-polymer, non-ionic surfactant (NI), linear alkyl benzene sulfonic acid anionic surfactant (LAS) and alcohol ethoxysulfate anionic surfactant (AES) are the components of the liquid detergent composition that provide the context and desired performance for the liquid detergent compositions as described herein.

A typical embodiment of the invention is a composition comprising at least about 5% total active surfactant, preferably from about to about 8 to about 35% by weight of the composition and about 0.35 to 0.40% active DADMAC Acrylamide co-polymer in a carrier, wherein the surfactant comprises at least about 30 weight percent a non-ionic surfactant (NI) based on weight of the total active surfactant and at least one of a alcohol an ethoxysulfate (AES) and a linear alkylbenzene sulfonate (LAS) and; an effective amount of other laundry adjunct materials; and the balance of a carrier, preferably water.

DADMAC Acrylamide Co-polymer

As used herein "DADMAC Acrylamide co-polymer" refers to Diallyldialkylammonium Chloride Acrylamide copolymers, which are species of cationic polyquaternium-6 polymers. They can be produced in accordance with the procedures disclosed in U.S. Pat. No. 4,715,962.

When used in the detergent compositions, the DADMAC Acrylamide co-polymer typically comprises less than 1 weight percent based on total weight of the detergent composition. In preferred embodiments, the active amount of DADMAC Acrylamide co-polymer comprises less than 0.5 weight percent based on total weight of the detergent composition. In certain preferred embodiments, the active amount of DADMAC Acrylamide co-polymer is about 0.35 to about 0.40 weight percent based on total weight of the detergent composition.

Surfactants

The detergent composition comprises one or more surfactants, of which one or more is nonionic, and the additional surfactants may be anionic and/or cationic and/or non-ionic and/or semi-polar and/or zwitterionic, or a mixture thereof. In a particular embodiment, the detergent composition includes a mixture of non-ionic surfactant and one or more other anionic surfactants. The total active surfactant(s) is typically present at a level of from about 5% to 40% by weight, such as about 8% to about 35%, or about 10% to about 28%, or about 12% to about 13% base on total weight of the detergent composition. The surfactant(s) is chosen based on the desired cleaning application, and may include any conventional surfactant(s) known in the art.

Non-Ionic Surfactants

Non-ionic surfactants (NI) are useful in the context of this invention to both improve the cleaning properties of the compositions, when used as a detergent, and to contribute to product stability. A wide range of non-ionic surfactants can be used herein. For example, the non-ionic surfactants include, but are not limited to alkoxylated alcohols, polyoxyalkylene alkyl, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof. Preferably, the non-ionic surfactant is an alcohol ethoxylate (AE).

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (II):

$$R_2—(—O—C_2H_4—)_m—OH \quad (II)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_6$-$C_{14}$ alkyl, or $C_6$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

The use of NI is critical to the appearance and stability of the detergent composition. If less than 2 weight percent NI is included in the detergent composition, it will be unstable, resulting in a cloudy appearance and/or phase separation. When the amount of NI is about 30 to 100 weight percent of the surfactant system, the detergent compositions are expected to have a turbidity of about 50 NTUs or less.

The amount of NI is typically about 2 weight percent to about 35 weight percent based on the total weight of the detergent composition. Preferably, the NI is at least about 3 weight percent to about 28 weight percent, most preferably about 4 to about 26 weight percent based on total weight of the detergent composition.

In some embodiments, the amount of non-ionic surfactant in the surfactant system is selected so as to form a structured surfactant system with LAS and, optionally, AES. In some embodiments, the surfactant system comprises about 30 to about 100 wt % of a non-ionic surfactant, based on the total weight the surfactant system. In certain embodiments, the surfactant system comprises about 45 to about 80 wt %, or about 50 to 75 wt % of non-ionic surfactant, based on the total weight the surfactant system.

In some embodiments, the surfactant system of the present disclosure comprises from about 30 to about 100 wt %, from about 45 to about 80 wt %, about 50 to about 75 wt %, of AE, based on the total weight the surfactant system.

In certain embodiments, the NI may be about 30 to about 40 wt %, about 40 to about 50 wt %, about 50 to about 60 wt %, about 60 to about 70 wt %, about 70 to about 80 wt %, about 80 to about 90 wt %, or about 90 to about 100 wt %, based on total weight of the surfactant system. In some embodiments, the amount of NI may be about 30 to 35, 35 to 40, 40 to 45, 45 to 50, 50 to 55, 55 to 60, 60 to 65, 65 to 70, 70 to 75, 75 to 80, 80 to 85, 85 to 90, 90 to 95, or 95 to 1000 wt % based on the weight of the surfactant system.

Anionic Surfactants

Anionic surfactants are useful in the context of this invention to both improve the cleaning properties of the compositions, when used as a detergent, and to contribute to product stability. The anionic surfactants used in this invention can be any anionic surfactant that is substantially water soluble. "Water soluble" surfactants are, unless otherwise noted, here defined to include surfactants which are soluble or dispersible to at least the extent of 0.01% by weight in distilled water at 25° C. "Anionic surfactants" are defined herein as amphiphilic molecules with an average molecular weight of less than about 10,000, comprising one or more functional groups that exhibit a net anionic charge when in aqueous solution at the normal wash pH of between 6 and 11.

Non-limiting examples of anionic surfactants include sulfates and sulfonates, in particular, linear alkylbenzenesulfonates (LAS), isomers of LAS, branched alkylbenzenesulfonates (BABS), phenylalkanesulfonates, alpha-olefinsulfonates (AOS), olefin sulfonates, alkene sulfonates, alkane-2,3-diylbis(sulfates), hydroxyalkanesulfonates and disulfonates, alkyl sulfates (AS) such as sodium dodecyl sulfate (SDS), fatty alcohol sulfates (FAS), primary alcohol sulfates (PAS), alcohol ethersulfates (AES or AEOS or FES, also known as alcohol ethoxysulfates or fatty alcohol ether sulfates), secondary alkanesulfonates (SAS), paraffin sulfonates (PS), ester sulfonates, sulfonated fatty acid glycerol esters, alpha-sulfo fatty acid methyl esters (alpha-SFMe or SES) including methyl ester sulfonate (MES), alkyl- or alkenylsuccinic acid, dodecenyl/tetradecenyl succinic acid (DTSA), fatty acid derivatives of amino acids, diesters and monoesters of sulfo-succinic acid or salt of fatty acids (soap), and combinations thereof.

If included, the detergent composition will usually contain from about 0.5% to about 25% by weight of anionic surfactant, such as from about 1% to about 20%, including from about 5% to about 10%, or from about 4% to about 9% by weight of anionic surfactant.

Linear alkylbenzene sulfonates (LAS) refers to water soluble salts of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids. Suitable LAS includes sodium and potassium linear, alkylbenzene sulfonates in which the average number of carbon atoms in the alkyl group is between 11 and 14. Sodium $C_{11}$-$C_{14}$ (e.g., $C_{12}$) LAS is one suitable anionic surfactant for use herein. Exemplary LAS used herein include LAS sulfonic acid.

If included in the detergent compositions, the amount of LAS must be below about 15 percent by weight of the detergent composition. The amount of LAS is typically about 0.05 weight percent to about 15 weight percent based on the total weight of the detergent composition. Preferably, the LAS is at least about 0.8 weight percent, most preferably about 1.5 to about 12 weight percent or about 1.5 to about 10.5 weight percent based on total weight of the detergent composition.

In some embodiments, the amount of LAS is selected so as to form a structured surfactant system with NI and, optionally, AES. The amount of LAS, however, must be below about 40 weight percent, based on the weight of the surfactant system. In some embodiments, the surfactant system contains about 0 to about 40 wt %, about 10 to about 35 wt %, or about 20 to 30 wt % of linear alkylbenzene sulfonate, based on the total weight the surfactant system. In certain preferred embodiments, the LAS is about 20 to 40 wt % or 20-35 wt % of the surfactant system.

In certain embodiments, the LAS may be about 0 to about 10 wt %, about 10 to about 20 wt %, about 20 to about 30 wt %, or about 30 to about 40 wt %, based on total weight of the surfactant system. In some embodiments, the amount of LAS may be about 0 to 5, 5 to 10, 10 to 15, 15 to 20, 20 to 25, 25 to 30, 30 to 35, or 35 to 40 wt % based on the weight of the surfactant system.

In certain embodiments, the ratio of LAS to non-ionic surfactant (e.g. AE) is from about 1:1.5 to about 1:6. In certain of those embodiments, the ratio of LAS:NI is 1:3; in other embodiments, the ratio of LAS:NI is about 1:3.5. In yet other embodiment, the ratio of LAS:NI is about 1:5.5.

Alcohol ethoxysulfates (AES or AEOS or FES, also known as alcohol ethersulfates or fatty alcohol ether sulfates) are a group of an anionic surfactants critical to achieving a clear, stable composition having at least one DADMAC Acrylamide co-polymer.

"Alcohol ethoxysulfate (AES)" as contemplated herein refers to compounds having Formula (I):

$$R_1—O—(C_2H_4O)_n—SO_3M \quad (I),$$

wherein $R_1$ is a $C_8$-$C_{22}$ alkyl group, n is from 1 to 20, and M is a salt-forming cation. Preferably, $R_1$ is a $C_{10}$-$C_{18}$ alkyl, or a $C_{10}$-$C_{15}$ alkyl, n is from 1 to 15, 1 to 10, or 1 to 8, and M is sodium, potassium, ammonium, alkylammonium, or alkanolammonium. More preferably, $R_1$ is a $C_{12}$-$C_{16}$ alkyl, n is from 1 to 6, and M is sodium. In one embodiment, the alkyl ether sulfate is sodium lauryl ether sulphate (SLES). The AES will generally be used in the form of mixtures comprising varying $R_1$ chain lengths and varying degrees of ethoxylation. Frequently such mixtures will inevitably also contain some unethoxylated alkyl sulfate materials, i.e., n=0 in the above Formula (I). Unethoxylated alkyl sulfates may also be added separately to the aqueous surfactant system of present disclosure and used as or in any anionic surfactant component which may be present. Suitable unalkoyxylated, e.g., unethoxylated, alkyl ether sulfate surfactants are those made by the sulfation of higher $C_8$-$C_{20}$ fatty alcohols. Conventional alkyl sulfate surfactants may also be suitable herein, which have the general formula of: $R_1OSO_3M^+$, wherein $R_1$ and M each has the same definition as described above.

If included, the amount of AES must be below 25% by weight of the detergent composition. The amount of AES used is typically about 0.5 weight percent to about 25 weight percent based on the total weight of the detergent composition. Preferably the AES is at least about 1 weight percent, but less than about 15 weight percent based on total weight of the detergent composition. Most preferably, the AES is about to about 0.8% to about 12.5% by weight of the total detergent composition.

It is highly preferably that the AES is used in a surfactant system that also includes a non-ionic surfactant and a linear alkylbenzene sulfonate. The total active surfactant in the detergent composition may include additional surfactants in addition to those in the NI/LAS/AES surfactant system.

In terms of the NI/LAS/AES surfactant system, the amount of AES is less than 70 weight percent based on the total weight of the NI/LAS/AES surfactant system. More typically, the amount of AES is less than 55%, more preferably less than 50%, most preferably less than 40% by weight of surfactant system.

In some embodiments, the AES may be about 0 to about 10 wt %, about 10 to about 20 wt %, about 20 to about 30 wt %, about 30 to about 40 wt %, about 40 to about 50 wt %, about 50 to about 60 wt %, about 60 to about 70 wt %, based on total weight of the surfactant system. In some embodiments, the amount of AES may be about 30 to 35, 35 to 40, 40 to 45, 45 to 50, 50 to 55, 55 to 60, 60 to 65, 65 to 70, 70 to 75, 75 to 80, 80 to 85, 85 to 90, 90 to 95, or 95 to 1000 wt % based on the weight of the surfactant system.

In certain embodiments, the AES may be about 0 to about 70 wt %, about 0 to about 55 wt %, about 20 to about 55 wt %, about 10 to about 40 wt %, or about 10 to about 35 wt % based on the total weight of the surfactant system.

In other embodiments, the AES may be about 0 to 5, 5 to 10, 10 to 15, 15 to 20, 20 to 25, 25 to 30, 30 to 35, 35 to 40, 40 to 45, 45 to 50, 50 to 55, or 55 to 60, 60 to 65, or 65 to 70 wt %, based on the total weight of the surfactant system.

Preferably, the AES is about 0 to about 55 weight percent based on weight of the NI/LAS/AES surfactant system. Most preferably, the AES is about 10 to about 50 weight percent based on weight of the NI/LAS/AES surfactant system.

In some embodiments, the ratio of LAS:AES:NI is about 1:3.4:5.6. In other embodiments, the ratio of LAS:AES:NI is about 1.0:0.5:3.6. In yet other embodiments, the ratio of LAS:AES:NI is about 1:1:1.5. In some other embodiments, the ratio of LAS:AES:NI is about 1:2:3.6.

Ternary Plot

The Ternary plot of the FIGURE illustrates the preferred desired ranges of AES, LAS, and NI in an embodiment of a surfactant system having one, two or three of the AES, LAS, and NI components. The X (bottom) axis of the plot represents the relative quantity of LAS in a surfactant system where 0-1.0 represent 0%-100%. The Z (left) axis of the plot represents the relative quantity of AES in a surfactant system where 0-1.0 represent 0%-100%. The Y (right) axis of the plot represents the relative quantity of NI in a surfactant system where 0-1.0 represent 0%-100%. The trapezoid area at the bottom right of the plot bounded by a dark line represents formulations as described in the Examples below providing a clear product having a turbidity of about 50 NTUs or less. The area outside the bounded trapezoid area, at the bottom left and top left of the plot, represents formulations having unacceptable cloudiness, e.g. a turbidity of greater than 50 NTUs.

Preferably, compositions will have AES:NI:LAS ratio corresponding to the area between coordinates 0.55:0.45:0, 0.2:0.8:0, 0:0.8:0.2, 0:0.6:0.4 and 0.3:0.35:0.35, which corresponds to a five-sided polygon. Particularly preferred compositions have AES:NI:LAS ratio corresponding to the area between coordinates 0.5:0.5:0, 0.25:0.75:0, 0.1:0.7:0.2, and 0.3:0.4:0.3, which corresponds to a four-sided polygon.

Cationic Surfactant

When included therein the detergent will usually contain from about from about 1% to about 40% by weigh of a cationic surfactant, for example from about 0.5% to about 30%, in particular from about 1% to about 20%, from about 3% to about 10%, such as from about 3% to about 5%, from about 8% to about 12% or from about 10% to about 12%. Non-limiting examples of cationic surfactants include alkyldimethylethanolamine quat (ADMEAQ), cetyltrimethylammonium bromide (CTAB), dimethyldistearylammonium chloride (DSDMAC), and alkylbenzyldimethylammonium, alkyl quaternary ammonium compounds, alkoxylated quaternary ammonium (AQA) compounds, ester quats, and combinations thereof.

Semipolar Surfactant

When included therein the detergent will usually contain from about 0% to about 40% by weight of a semipolar surfactant. Non-limiting examples of semipolar surfactants include amine oxides (AO) such as alkyldimethylamineoxide, N-(coco alkyl)-N,N-dimethylamine oxide and N-(tallow-alkyl)-N,N-bis(2-hydroxyethyl)amine oxide, and combinations thereof.

Zwitterionic Surfactant

When included therein the detergent will usually contain from about 0% to about 40% by weight of a zwitterionic surfactant. Non-limiting examples of zwitterionic surfactants include betaines such as alkyldimethylbetaines, sulfobetaines, and combinations thereof.

Carrier

The optional, but preferred, carrier in the present compositions can be water alone or mixtures of organic solvents with water. Suitable organic solvents are linear or branched lower (C1-C8) alcohols, diols glycerols or glycols; lower amine solvents such as $C_1$-$C_4$ alkanolamines, and mixtures thereof. Exemplary organic solvents include 1,2-propanediol, ethanol, glycerol, monoethanolamine and triethanolamine. Carriers typically are present at levels in the range of from about 0.1% to about 98%, preferably at least about 10% to about 95%, more usually from about 25% to about 75%. Highly preferred compositions afforded by the present invention are clear, isotropic liquids.

Optional Ingredients

In addition to the above-mentioned essential elements, the formulator may include one or more optional ingredients. While it is not necessary for these elements to be present in order to practice this invention, the use of such materials is often very helpful in rendering the formulation acceptable for consumer use.

Examples of optional components include, but are not limited to: hydrotropes, fluorescent whitening agents, photobleaches, fiber lubricants, reducing agents, enzymes, enzyme stabilizing agents, powder finishing agents, defoamers, builders, bleaches, bleach catalysts, soil release agents, antiredeposition agents, dye transfer inhibitors, buffers, colorants, fragrances, pro-fragrances, rheology modifiers, anti-ashing polymers, preservatives, insect repellents, soil repellents, water-resistance agents, suspending agents, aesthetic agents, structuring agents, sanitizers, solvents, fabric finishing agents, dye fixatives, wrinkle-reducing agents, fabric conditioning agents and deodorizers.

Enzymes

Suitable enzymes include those known in the art, such as amylolytic, proteolytic, cellulolytic or lipolytic type, and those listed in U.S. Pat. No. 5,958,864. One preferred protease is a subtillase from *Bacillus lentus*. Other suitable enzymes include proteases, amylases, lipases and cellulases. Also suitable for use in the present disclosure are blends of two or more of these enzymes, for example a protease/lipase blend, a protease/amylase blend, a protease/amylase/lipase blend, and the like.

Preservatives

Optionally, a soluble preservative may be added to this invention. Contamination of the product by microorganisms, which can occur through both raw materials and consumer use, can have a number of undesirable effects. These include phase separation, the formation of bacterial and fungal colonies, the emission of objectionable odors and the like. The use of a preservative is especially preferred when the composition of this invention is a liquid, as these products tend to be especially susceptible to microbial growth.

A broad-spectrum preservative, which controls the growth of bacteria and fungi may be used. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention. Suitable biocidal agents include an anti-microbial, a germicide, or a fungicide. For example, a biocidal agent includes triclosan (5-chloro-2-(2,4-dichloro-phenoxy) phenol)), and the like.

In order to minimize environmental waste and allow for the maximum window of formulation stability, it is preferred that preservatives that are effective at low levels be used. Typically, they will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between about 0.00001% and about 0.5% of the total formula, based on weight. Obviously, however, the effective level will vary based on the material used, and one skilled in the art should be able to select an appropriate preservative and use level.

Preferred preservatives for the compositions of this invention include organic sulfur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: 5-chloro-2-methyl-4-isothiazolin-3-one, 2-methyl-4-isothiazolin-3-one, 1,2-benzisothiazolin-3-one, 1,3 bis (hydroxymethyl)-5,5-dimethyl-2,4 imidazolidinedione and 3-butyl-2-iodopropynyl carbamate.

The preservatives described above are generally only used at an effective amount to give product stability. It is conceivable, however, that they could also be used at higher levels in the compositions on this invention to provide a biostatic or antibacterial effect on the treated articles.

Fluorescent Whitening Agents

Many fabrics, and cottons in particular, tend to lose their whiteness and adopt a yellowish tone after repeated washing. As such, it is customary and preferred to add a small amount of fluorescent whitening agent, which absorbs light in the ultraviolet region of the spectrum and re-emits it in the visible blue range, to the compositions of this invention, especially if they are combination detergent/fabric conditioner preparations.

Suitable fluorescent whitening agents include derivatives of diaminostilbenedisulfonic acid and their alkali metal salts. Particularly, the salts of 4,4'-bis(2-anilino4-morpholino-1,3,5-triazinyl-6-amino)stilbene-2,2'-disulfonic acid, and related compounds where the morpholino group is replaced by another nitrogen-comprising moiety, are preferred. Also preferred are brighteners of the 4,4'-bis(2-sulfostyryl) biphenyl type, which may optionally be blended with other fluorescent whitening agents at the option of the formulator. Typical fluorescent whitening agent levels in the preparations of this invention range between 0.001% and 1%, although a level between 0.1% and 0.3%, by mass, is normally used.

Suitable optical brighteners include stilbenes, distyrylbiphenyl derivatives, stilbene/naphthotriazole blends, oxazole derivatives, or coumarin brighteners.

Builders

Builders are often added to fabric cleaning compositions to complex and remove alkaline earth metal ions, which can interfere with the cleaning performance of a detergent by combining with anionic surfactants and removing them from the wash liquor. The preferred compositions of this invention, especially when used as a combination detergent/softener, contain builders.

Soluble builders, such as alkali metal carbonates and alkali metal citrates, are particularly preferred, especially for the liquid embodiment of this invention. Other builders, as further detailed below, may also be used, however. Often a mixture of builders, chosen from those described below and others known to those skilled in the art, will be used.

Alkali and alkaline earth metal carbonates, such as those detailed in German patent application 2,321,001, published Nov. 15, 1973, are suitable for use as builders in the compositions of this invention. They may be supplied and used either in anhydrous form, or including bound water. Particularly useful is sodium carbonate, or soda ash, which both is readily available on the commercial market and has an excellent environmental profile.

The sodium carbonate used in this invention may either be natural or synthetic, and, depending on the needs of the formula, may be used in either dense or light form. Natural soda ash is generally mined as trona and further refined to a degree specified by the needs of the product it is used in. Synthetic ash, on the other hand, is usually produced via the Solvay process or as a coproduct of other manufacturing operations, such as the synthesis of caprolactam. It is sometimes further useful to include a small amount of calcium carbonate in the builder formulation, to seed crystal formation and increase building efficacy.

Organic detergent builders can also be used as nonphosphate builders in the present invention. Examples of organic builders include alkali metal citrates, succinates, malonates, fatty acid sulfonates, fatty acid carboxylates, nitrilotiacetates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysacchardes, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062. Alkali metal citrates, nitrilotriacetates, oxydisuccinates, acrylate/maleate copolymers and acrylate/maleate/vinyl alcohol terpolymers are especially preferred nonphosphate builders.

The compositions of the present invention which utilize a water-soluble phosphate builder typically contain this builder at a level of from 1 to 90% by weight of the composition. Specific examples of water-soluble phosphate builders are the alkali metal tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Phosphates are, however, often difficult to formulate, especially into liquid products, and have been identified as potential agents that may contribute to the eutrophication of lakes and other waterways. As such, the preferred compositions of this invention comprise phosphates at a level of less than about 10% by weight, more preferably less than about 5% by weight. The most preferred compositions of this invention are formulated to be substantially free of phosphate builders.

Zeolites may also be used as builders in the present invention. A number of zeolites suitable for incorporation into the products of this disclosure are available to the formulator, including the common zeolite 4A. In addition, zeolites of the MAP variety, such as those taught in European Patent Application EP 384,070B are also acceptable for incorporation. MAP is defined as an alkali metal aluminosilicate of zeolite P type having a silicon to aluminum ratio not exceeding 1.33, preferably within the range of from 0.90 to 1.33, more preferably within the range of from 0.90 to 1.20.

Especially preferred is zeolite MAP having a silicon to aluminum ratio not exceeding 1.07, more preferably about 1.00. The particle size of the zeolite is not critical. Zeolite A or zeolite MAP of any suitable particle size may be used. In any event, as zeolites are insoluble matter, it is advantageous to minimize their level in the compositions of this invention. As such, the preferred formulations contain less than about 10% of zeolite builder, while especially preferred compositions compress less than about 5% zeolite.

Enzyme Stabilizers

When enzymes, and especially proteases are used in liquid detergent formulations, it is often necessary to include a suitable quantity of enzyme stabilizer to temporarily deactivate it until it is used in the wash. Examples of suitable enzyme stabilizers are well-known to those skilled in the art, and include, for example, borates and polyols such as propylene glycol. Borates are especially suitable for use as enzyme stabilizers because in addition to this benefit, they can further buffer the pH of the detergent product over a wide range, thus providing excellent flexibility.

If a borate-based enzyme stabilization system is chosen, along with one or more cationic polymers that are at least partially comprised of carbohydrate moeities, stability problems can result if suitable co-stabilizers are not used. It is believed that this is the result of borates' natural affinity for hydroxyl groups, which can create an insoluble borate-polymer complex that precipitates from solution either over time or at cold temperatures. Incorporating into the formulation a co-stabilizer, which is normally a diol or polyol, sugar or other molecule with a large number of hydroxyl groups, can ordinarily prevent this. Especially preferred for use as a co-stabilizer is sorbitol, used at a level that is at least about 0.8 times the level of borate in the system, more preferably 1.0 times the level of borate in the system and most preferably more than 1.43 times the level of borate in the system, is sorbitol, which is effective, inexpensive, biodegradable and readily available on the market. Similar materials including sugars such as glucose and sucrose, and other polyols such as propylene glycol, glycerol, mannitol, maltitol and xylitol, should also be considered within the scope of this invention.

Fiber Lubricants

In order to enhance the conditioning, softening, wrinkle-reduction and protective effects of the compositions of this invention, it is often desirable to include one or more fiber lubricants in the formulation. Such ingredients are well known to those skilled in the art, and are intended to reduce the coefficient of friction between the fibers and yarns in articles being treated, both during and after the wash process. This effect can in turn improve the consumer's perception of softness, minimize the formation of wrinkles and prevent damage to textiles during the wash. For the purposes of this disclosure, "fiber lubricants" shall be considered non-cationic materials intended to lubricate fibers for the purpose of reducing the friction between fibers or yarns in an article comprising textiles which provide one or more wrinkle-reduction, fabric conditioning or protective benefit.

Examples of suitable fiber lubricants include oily sugar derivatives, functionalized plant and animal-derived oils, silicones, mineral oils, natural and synthetic waxes and the like. Such ingredients often have low HLB values, less than about 10, although exceeding this level is not outside of the scope of this invention.

Oily sugar derivatives suitable for use in this invention are taught in WO 98/16538, which is incorporated herein by reference. These are especially preferred as fiber lubricants, due to their ready availability and favorable environmental profile. When used in the compositions of this invention, such materials are typically present at a level between about 1% and about 10% of the finished composition. Another class of acceptable ingredients includes hydrophilically-modified plant and animal oils and synthetic triglycerides. Suitable and preferred hydrophilically modified plant, animal, and synthetic triglyceride oils and waxes have been identified as effective fiber lubricants. Such suitable plant derived triglyceride materials include hydrophilically modified triglyceride oils, e.g. sulfated, sulfonated, carboxylated, alkoxylated, esterified, saccharide modified, and amide derivatized oils, tall oils and derivatives thereof, and the like. Suitable animal derived triglyceride materials include hydrophilically modified fish oil, tallow, lard, and lanolin wax, and the like. An especially preferred functionalized oil is sulfated castor oil.

Various levels of derivatization may be used provided that the derivatization level is sufficient for the oil or wax derivatives to become soluble or dispersible in the solvent it is used in so as to exert a fiber lubrication effect during laundering of fabrics with a detergent containing the oil or wax derivative.

If this invention includes a functionalized oil of synthetic origin, preferably this oil is a silicone oil. More preferably, it is either a silicone poly ether or amino-functional silicone. If this invention incorporates a silicone polyether, it is preferably of one of the two general structures shown below:

Structure A

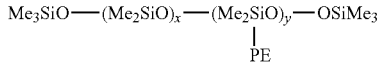

$$Me_3SiO—(Me_2SiO)_x—(Me_2SiO)_y—OSiMe_3$$
$$\quad\quad\quad trimethyl-1,4,7-triazacyclononane)-$(OCH_3)_3(PF_6)$, and mixtures thereof. Other metal-based bleach catalysts include those disclosed in U.S. Pat. Nos. 4,430,243 and 5,114,611. Other examples of complexes of transition metals include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2]\text{-}(ClO_4)_3$.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606, is a water soluble complex of manganese (II), (Ill), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

Other bleach catalysts are described, for example, in European Pat. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (Chelants with manganese cations and non-catalytic metal cations), and U.S. Pat. No. 4,728,455 (manganese gluconates).

Useful catalysts based on cobalt are described in WO 96/23859, WO 96/23860 and WO 96/23861 and U.S. Pat. No. 5,559,261. WO 96/23860 describe cobalt catalysts of the type $[CO_nL_mX_p]^zY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis(salicylidene)ethylenediaminecobalt (II). Other cobalt catalysts described in these applications are based on Co(III) complexes with ammonia and mono-, bi-, tri- and tetradentate ligands such as $[Co(NH_3)_5OAc]^{2+}$ with $Cl^-$, $OAc^-$, $PF_6^-$, $SO_4^{=}$, and $BF_4^-$ anions.

Certain transition-metal containing bleach catalysts can be prepared in the situ by the reaction of a transition-metal salt with a suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Hydrotropes

In many liquid detergent compositions, it is customary to add a hydrotrope to modify product viscosity and prevent phase separation.

Two types of hydrotropes are typically used in detergent formulations and are applicable to this invention. The first of these are short-chain functionalized amphiphiles. Examples of short-chain amphiphiles include the alkali metal salts of xylenesulfonic acid, cumenesulfonic acid and octyl sulfonic acid, and the like. In addition, organic solvents and monohydric and polyhydric alcohols with a molecular weight of less than about 500, such as, for example, ethanol, isopropanol, acetone, propylene glycol and glycerol, may also be used as hydrotropes.

Soil Release Agents

In order to prevent the resoiling of fabrics during and after the wash, one or more soil release agents may also be added to the products of this invention. Many different types of soil release agents are known to those skilled in the art, depending on the formulation in use and the desired benefit. The soil release agents useful in the context of this invention are typically either antiredeposition aids or stain-repelling finishes.

Suitable anti-redeposition agents are typically polycarboxylate materials. Polycarboxylate materials, which can be prepared by polymerizing or copolymerizing suitable unsaturated monomers, are admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40 wt % of the polymer.

Particularly suitable polycarboxylates can be derived from acrylic acid. Such acrylic acid-based polymers which are useful herein are the water-soluble salts of polymerised acrylic acid. The average molecular weight of such polymers in the acid form ranges from about 2,000 to 10,000, from about 4,000 to 7,000, or from about 4,000 to 5,000. Water-soluble salts of such acrylic acid polymers can include, for example, the alkali metal, ammonium and substituted ammonium salts. Soluble polymers of this type are known materials (e.g., those described in U.S. Pat. No. 3,308,067). In one embodiment, the polycarboxylate is sodium polyacrylate.

Acrylic/maleic-based copolymers may also be used as a component of the anti-redeposition agent. Such materials include the water-soluble salts of copolymers of acrylic acid and maleic acid. The average molecular weight of such copolymers in the acid form ranges from about 2,000 to 100,000, from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Soluble acrylate/maleate copolymers are known materials (e.g., those described in EP 193360). Other useful polymers include maleic/acrylic/vinyl alcohol terpolymers (e.g., a terpolymer containing 45/43/10 of acrylic/maleic/vinyl alcohol as described in EP 193360).

Polyethylene glycol can act as a clay soil removal-anti-redeposition agent. Molecular weight of suitable polyethylene glycol can range from about 1,000 to about 50,000, or about 3,000 to about 10,000. Polyaspartate and polyglutamate dispersing agents may also be used herein.

Any polymeric soil release agent known to those skilled in the art can optionally be employed herein as well. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Exemplary anti-redeposition agents include an acrylic polymer, an acrylic acid/maleic acid copolymer, an anionic polymer, and an ethoxylated polyethylene imine.

Suitable soil-releasing polymers include, but are not limited to, a nonionic polyester of polypropylene terephthalate, a polyethylene glycol polyester (Solvay); end-capped and non-end-capped sulfonated and unsulfonated PET/POET polymers of the type as disclosed in WO 2010/069957 and WO 1995/032997; polyethylene glycol/polyvinyl alcohol graft copolymers, and anionic hydrophobic polysaccharides of the type as disclosed in U.S. Pat. No. 6,764,992. Each of the patent references is incorporated herein by reference in its entirety.

In addition, the cationic polymers of this invention are particularly advantageous when used in conjunction with a stain-repelling finish. Such materials are typically either fluoropolymers or fluorosurfactants, although the use of other amphiphilic materials with extremely hydrophobic lyophobes, such as silicone surfactants, is also conceivable. Nonlimiting examples of suitable anionic fluorosurfactants are taught in U.S. Pat. No. 6,040,053, which is incorporated herein by reference. Without wishing to be bound by theory, it is believed that the cationic polymers of this invention coordinate to the fabric surface and act as a substrate and deposition aid for the stain-repelling finish.

When an antiredeposition aid or stain-repelling finish is used, it is typically applied as 0.05% to 10% of the finished composition.

Insoluble Matter

It is preferred that the compositions of this disclosure be formulated with low levels, if any at all, of any matter that is substantially insoluble in the solvent intended to be used to dilute the product. For the purposes of this disclosure, "substantially insoluble" shall mean that the material in question can individually be dissolved at a level of less than 0.001% in the specified solvent. Examples of substantially insoluble matter in aqueous systems include, but are not limited to aluminosilicates, pigments, clays and the like. Without wishing to be bound by theory, it is believed that solvent-insoluble inorganic matter can be attracted and coordinated to the cationic polymers of this invention, which are believed to attach themselves to the articles being washed. When this occurs, it is thought that these particles can create a rough effect on the fabric surface, which in turn reduces the perception of softness.

In addition, as liquid compositions are a preferred embodiment of this invention, and insoluble matter is often difficult to formulate into a liquid, it is further desirable to minimize its level in the product. For this invention it is desirable to have the liquid compositions be substantially transparent for esthetic reasons. Thus, for the compositions of this invention it is desirable to have a percent transmittance of light of greater than about 50 using a 1 centimeter cuvette at a wavelength of 570 nanometers wherein the composition is measured in the absence of dyes. Alternatively, transparency of the composition may be measured as having an absorbence (A) at 570 nanometers of less than about 0.3 which is in turn equivalent to percent transmittance of greater than about 50 using the same cuvette as above. The relationship between absorbance and percent transmittance is:

$$\text{Percent Transmittance}=100(1/\text{inverse log } A)$$

Preferably, insoluble and substantially insoluble matter will be limited to less than 10% of the composition, more preferably 5%. Most preferably, especially in the case of liquid conditioning compositions, the composition will be essentially free of substantially insoluble matter.

Dyes and Perfumes

Although it is preferred that the compositions disclosed herein are free of perfumes and dyes, the compositions may contain such ingredients.

Fragrance (perfume) refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. The fragrance can comprise an ester, an ether, an aldehyde, a ketone, an alcohol, a hydrocarbon, or a mixture thereof.

Typically, perfumes are complex mixtures of blends of various organic compounds such as alcohols, aldehydes, ethers, aromatic compounds and varying amounts of essential oils (e.g., terpenes). The essential oils themselves are volatile odoriferous compounds and also serve to dissolve the other components of the perfume.

In some embodiments, the fragrance component is in the form of free fragrance. In some embodiments, at least some of the fragrance can be encapsulated in, for example, water-insoluble shell, microcapsule, nanocapsule or any combination thereof. The microcapsules can be water-soluble or water-insoluble.

Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety.

The fragrance (perfume) can have, for example, a musky scent, a putrid scent, a pungent scent, a camphoraceous scent, an ethereal scent, a floral scent, a peppermint scent, or any combination thereof. The fragrance comprises methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

All dyes (colorants) suitable for use in detergent composition can be used in herein. A variety of dye colors can be used, such as blue, yellow, green, orange, purple, clear, etc. Suitable dyes include, but are not limited to chromophore types, e.g., azo, anthraquinone, triarylmethane, methine quinophthalone, azine, oxazine thiazine, which may be of any desired color, hue or shade. Suitable dyes can be obtained from any major supplier such as Clariant, Ciba Speciality Chemicals, Dystar, Avecia or Bayer.

The preferred pH range of the composition is 2-12. Because many cationic polymers can decompose at high pH, especially when they contain amine or phosphine moieties, it is desirable to keep the pH of the composition below the $pK_a$ of the amine or phosphine group that is used to quaternize the selected polymer, below which the propensity for this to occur is greatly decreased. This reaction can cause the product to lose effectiveness over time and create an undesirable product odor. As such, a reasonable margin of safety, of 1-2 units of pH below the $pK_a$ should ideally be used in order to drive the equilibrium of this reaction to strongly favor polymer stability. Although the preferred pH of the product will depend on the particular cationic polymer selected for formulation, typically these values should be below about 8.5 to 10. Wash liquor pH, especially in the case of powdered softener and combination detergent/softener products, can often be less important, as the kinetics of polymer decomposition are often slow, and the time of one wash cycle is typically not sufficient to allow for this reaction to have a significant impact on the performance or odor of the product. A lower pH can also aid in the formulation of higher-viscosity products.

Conversely, as the product depends on the presence of soluble anionic surfactants to provide softening, its pH should preferably be above the $pK_a$ of the surfactant acids used to formulate it. In addition, aqueous detergent products, which are a highly preferred embodiment of this invention, are nearly impossible to formulate below the $pK_a$ of the surfactant acids used, as these molecules are rather insoluble in water when in acid form. Again, it is especially desirable to have the pH at least 1-2 units above the $pK_a$ of the surfactant acids, to ensure that the vast majority of anionic surfactant is present in salt form. Typically, this will suggest that the product pH should be above about 4, although in certain cases, such as when carboxylic acid salts, which often have a $pK_a$ around 4 or 5, are used, the pH of the product can need to be above about 7 or 8 to ensure effective softening.

Preparation of the Compositions of the Invention

Incorporation of surfactants and DADMAC polymer into compositions of the invention can be done in any suitable manner and can, in general, involve any order of mixing or addition.

For Example, the surfactants and/or DADMAC polymer as received from the manufacturer can be introduced directly into a preformed mixture of two or more of the other components of the final composition. This can be done at any point in the process of preparing the final composition, including at the very end of the formulating process. That is, the surfactants and/or DADMAC polymer can be added to a pre-made liquid laundry detergent to form the final composition of the present invention.

In another example, the surfactants can be premixed with an emulsifier, a dispersing agent or a suspension agent to form an emulsion, a latex, a dispersion, a suspension, and the like, which is then mixed with other components (such as DADMAC polymer, detersive surfactants, etc.) of the final composition. These components can be added in any order and at any point in the process of preparing the final composition.

A third example involves mixing the surfactants or the DADMAC polymers with one or more adjuncts of the final composition and adding this premix to a mixture of the remaining adjuncts.

Method of Use

The following details a method for conditioning textiles comprising the steps, in no particular order of: a. providing a laundry detergent composition comprising at least one anionic surfactant and at least one cationic polymer, in a ratio and concentration to effectively soften and condition fabrics under predetermined laundering conditions; b. contacting one or more articles with the composition at one or more points during a laundering process; and c. allowing the articles to dry or mechanically tumble-drying them, wherein the softening parameter is greater than 40 and the composition comprises more than about 5% by weight of one or more anionic surfactants having an HLB of greater than about 4.

Amounts of composition used will generally range between about 10 g and about 300 g total product per 3 kg of conditioned fibrous articles, depending on the particular embodiment chosen and other factors, such as consumer preferences, that influence product use behavior.

A consumer that would use the present invention could also be specifically instructed to contact the fabrics with the inventive composition with the purpose of simultaneously cleaning and softening the fabrics. This approach would be recommended when the composition takes the form of a softening detergent to be dosed at the beginning of the wash cycle.

The following examples will more fully illustrate the embodiments of this invention. All parts, percentages and proportions referred to herein and in the appended claims are by weight unless otherwise illustrated. Physical test methods are described below.

EXAMPLES

Example 1

The following 8 Compositions were prepared. Composition 8 was a model liquid detergent.

TABLE 1

Formulation of Detergent Compositions 1-4

| Material/Description | Activity (%) | Comp. 1 w/w (%) | Comp. 2 w/w (%) | Comp. 3 w/w (%) | Comp. 4 w/w (%) |
|---|---|---|---|---|---|
| Water | 100.00 | 50.00 | 50.00 | 50.00 | 50.00 |
| Citric Add 50% solution | 50.00 | 8.80 | 8.80 | 8.80 | 8.80 |
| Triethanolamine | 85.00 | 1.48 | 1.48 | 1.48 | 1.48 |
| Alcohol Ethoxylate 25-7 | 100.00 | 2.08 | 7.04 | 9.06 | 4.97 |
| LAS Sulfonic Add | 96.00 | 5.16 | 1.26 | 2.35 | 6.63 |
| Coco fatty Acid | 100.00 | 0.50 | 0.50 | 0.50 | 0.50 |
| Sodium Hydroxide | 50.00 | | Adjust to pH 7.7 | | |
| AES | 60.00 | 9.20 | 7.16 | 2.05 | 2.03 |
| Performance Polymer | 80.00 | 0.07 | 0.07 | 0.07 | 0.07 |
| Optical Brightener | 100.00 | 0.10 | 0.10 | 0.10 | 0.10 |
| Chelator | 34.00 | 0.74 | 0.74 | 0.74 | 0.74 |
| Preservative | 8.60 | 0.09 | 0.09 | 0.09 | 0.09 |
| DADMAC-Acrylamide Co-Polymer | 45.00 | 0.67 | 0.67 | 0.67 | 0.67 |
| Water Soft | 100 | QS to 100 | QS to 100 | QS to 100 | QS to 100 |
| | Total | 100.00 | 100.00 | 100.00 | 100.00 |

TABLE 2

Formulation of Detergent Compositions 5-8

| Material/Description | Activity (%) | Comp. 5 w/w (%) | Comp. 6 w/w (%) | Comp. 7 w/w (%) | Comp. 8 w/w (%) |
|---|---|---|---|---|---|
| Water | 100.00 | 50.00 | 50.00 | 50.00 | 50.00 |
| Citric Acid 50% solution | 50.00 | 8.80 | 8.80 | 8.80 | 8.80 |
| Triethanolamine | 85.00 | 1.48 | 1.48 | 1.48 | 1.48 |
| Alcohol Ethoxylate 25-7 | 100.00 | 5.16 | 2.28 | 1.45 | 6.80 |
| LAS Sulfonic Acid | 96.00 | 3.91 | 1.64 | 9.25 | 1.82 |
| Coco fatty Acid | 100.00 | 0.50 | 0.50 | 0.50 | 0.50 |
| Sodium Hydroxide | 50.00 | | Adjust to pH 7.7 | | |
| AES | 60.00 | 6.06 | 14.49 | 3.69 | 6.67 |
| Performance Polymer | 80.00 | 0.07 | 0.07 | 0.07 | 0.07 |
| Optical Brightener | 100.00 | 0.10 | 0.10 | 0.10 | 0.10 |

TABLE 2-continued

| Formulation of Detergent Compositions 5-8 | | | | | |
|---|---|---|---|---|---|
| Material/Description | Activity (%) | Comp. 5 w/w (%) | Comp. 6 w/w (%) | Comp. 7 w/w (%) | Comp. 8 w/w (%) |
| Chelator | 34.00 | 0.74 | 0.74 | 0.74 | 0.74 |
| Preservative | 8.60 | 0.09 | 0.09 | 0.09 | 0.09 |
| DADMAC Acrylamide Co-Polymer | 45.00 | 0.67 | 0.67 | 0.67 | 0.67 |
| Water Soft | 100 | QS to 100 | QS to 100 | QS to 100 | QS to 100 |
| | Total | 100.00 | 100.00 | 100.00 | 100.00 |

Compositions 1 to 8 as depicted in TABLE 1 and TABLE 2 represent the active surfactant system ratios shown in TABLE 3. The amount of the active surfactant from the surfactant ingredients adds up to 12.55 percent of the total formula:

TABLE 3

| Surfactant Ratios of Compositions 1-8 Compositions 1-8 | | | |
|---|---|---|---|
| Composition | LAS | AES | NI |
| 1 | 0.39 | 0.44 | 0.17 |
| 2 | 0.10 | 0.34 | 0.56 |
| 3 | 0.18 | 0.10 | 0.72 |
| 4 | 0.51 | 0.10 | 0.40 |
| 5 | 0.30 | 0.30 | 0.41 |
| 6 | 0.13 | 0.70 | 0.18 |
| 7 | 0.71 | 0.18 | 0.12 |
| 8 | 0.14 | 0.32 | 0.54 |

Example 2

TABLE 4 includes the turbidity results for compositions 1-8 of Example 1. The turbidity was measured using a HACH 2100N turbidity meter and using De-ionized water as the 100% blank that registers 0 NTU.

TABLE 4

| Turbidity of Compositions 1-8 | |
|---|---|
| Composition | Turbidity NTUs |
| 1 | 270.0 |
| 2 | 11.0 |
| 3 | 8.0 |
| 4 | 69.5 |
| 5 | 31.0 |
| 6 | 173.0 |
| 7 | 215.0 |
| 8 | 12.4 |

Referring to the FIGURE, Compositions 2, 3, 5 and 8, all having a turbidity less than 50 NTUs, appear in the trapezoid in the lower right part of the ternary plot for LAS, AES and NI. In contrast, the compositions with turbidity above 50 NTUs all appear on the left side of the plot. It is expected that all systems having NI greater than 0.3 and LAS less than 0.4, and contained in right side of the ternary plot (depicted in the bolded trapezoid) will have turbidity less than 50 NTUs.

Preferable compositions have AES:NI:LAS ratio corresponding to the area between coordinates 0.55:0.45:0, 0.2:0.8:0, 0:0.8:0.2, 0:0.6:0.4 and 0.3:0.35:0.35, in the ternary plot. Particularly preferred compositions have AES:NI:LAS ratio corresponding to the area between coordinates 0.5:0.5:0, 0.25:0.75:0, 0.1:0.7:0.2, and 0.3:0.4:0.3 in the ternary plot of.

Example 3—Comparative Example

A DADMAC Acrylic Acid co-polymer was substituted for the DADMAC Acrylamide co-polymer of Example 1 and turbidity was measured in the same manner as Example 2. The turbidity of compositions 2-5, 7 and 8 was greater than 50 NTUs. It was unexpected that the DADMAC co-polymers behaved differently within the same compositions.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

All publications, patent applications, patents, and other references mentioned herein are incorporated by reference in their entirety. In case of conflict, the present specification, including definitions, will control. In addition, section headings, the materials, methods, and examples are illustrative only and not intended to be limiting.

What is claimed is:

1. A liquid laundry detergent composition comprising:

a Diallyldialkylammonium Chloride (DADMAC) Acrylamide co-polymer;

water present in an amount greater than 20 weight percent based on total weight of the detergent composition; and total active surfactant present in an amount of about 8 to about 35 weight percent based on total weight of the detergent composition, the total active surfactant comprising at least one non-ionic surfactant (NI), an alcohol ethoxysulfate anionic surfactant (AES), and at least one linear alkylbenzene sulfonate anionic surfactant (LAS), wherein weight ratio of the NI, AES, and LAS falls within a five-sided region of a ternary plot, wherein the five-sided region is defined by five points of the ratio of AES:NI:LAS:

(A) 0.55:0:45:0, (B) 0.2:0.8:0, (C) 0:0.8:0.2, (D) 0:0.6:0.4, (E) 0.3:0.35:0.35, wherein the composition has a turbidity of about 50 NTUs or less.

2. The liquid laundry detergent composition of claim 1, wherein the ratio of LAS:NI is about 1:1.5 to about 1:6.

3. The liquid laundry detergent composition of claim 1, wherein the NI is an alcohol ethoxylate (AE).

4. The liquid laundry detergent composition of claim 1, wherein the detergent composition does not include a perfume.

5. The liquid laundry detergent composition of claim 1, wherein the DADMAC Acrylic Acid co-polymer comprises less than 1 weight percent based on total weight of the detergent composition.

6. The liquid laundry detergent composition of claim 1, wherein the DADMAC Acrylamide co-polymer is about 0.35 to 0.40 by percent based on total weight of the detergent composition.

7. The liquid laundry detergent composition of claim 1, wherein the water is about 30 to about 80 weight percent based on total weight of the detergent composition.

8. The liquid laundry detergent composition of claim 1, wherein the surfactant system comprises about 10 percent to about 35 weight percent based on total weight of the detergent composition.

9. The liquid laundry detergent composition of claim 1, wherein the surfactant system comprises about 10 percent to about 28 weight percent based on total weight of the detergent composition.

10. A liquid laundry detergent composition comprising:

a Diallyldialkylammonium Chloride (DADMAC) Acrylamide co-polymer;

a surfactant system comprising at least one non-ionic surfactant (NI), an alcohol ethoxysulfate anionic surfactant (AES), and at least one linear alkylbenzene sulfonate anionic surfactant (LAS); and an aqueous carrier, wherein weight ratio of the NI, AES, and LAS falls within a four-sided region of a ternary plot, wherein the four-sided region is defined by four points of the ratio of AES:NI:LAS:

(A) 0.5:0.5:0, (B) 0.25:0.75:0, (C) 0.1:0.7:0.2, (D) 0.3:0.4:0.3, wherein the composition has a turbidity of about 50 NTUs or less.

11. The liquid laundry detergent composition of claim 10, wherein the composition has a turbidity of about 40 NTUs or less.

12. The liquid laundry detergent composition of claim 10, wherein the DADMAC Acrylamide co-polymer comprises less than 1 weight percent based on total weight of the detergent composition.

13. The liquid laundry detergent composition of claim 10, wherein water comprises about 30 to about 80 weight percent based on total weight of the detergent composition.

14. The liquid laundry detergent composition of claim 10, wherein the surfactant system comprises about 10 percent to about 35 weight percent based on total weight of the detergent composition.

15. The liquid laundry detergent composition of claim 10, wherein the surfactant system comprises about 10 percent to about 28 weight percent based on total weight of the detergent composition.

16. The liquid laundry detergent composition of claim 10, wherein the wherein the ratio of LAS:NI is about 1:1.5 to about 1:6.

17. The liquid laundry detergent composition of claim 10, wherein the DADMAC Acrylamide co-polymer is about 0.35 to 0.40 by percent based on total weight of the detergent composition.

18. The liquid laundry detergent composition of claim 10, wherein the NI is an alcohol ethoxylate.

* * * * *